US008534799B2

(12) United States Patent
Ikeuchi et al.

(10) Patent No.: US 8,534,799 B2
(45) Date of Patent: Sep. 17, 2013

(54) LIQUID DISCHARGE HEAD AND RECORDING DEVICE USING SAME

(75) Inventors: Wataru Ikeuchi, Kirishima (JP); Ayumu Matsumoto, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 13/322,902

(22) PCT Filed: Apr. 26, 2010

(86) PCT No.: PCT/JP2010/057356

§ 371 (c)(1), (2), (4) Date: Nov. 28, 2011

(87) PCT Pub. No.: WO2010/137435

PCT Pub. Date: Dec. 2, 2010

(65) Prior Publication Data

US 2012/0069104 A1 Mar. 22, 2012

(30) Foreign Application Priority Data

May 27, 2009 (JP) ..... 2009-127537

(51) Int. Cl.
*B41J 2/04* (2006.01)
*B41J 2/45* (2006.01)

(52) U.S. Cl.
USPC ..... 347/54; 347/68

(58) Field of Classification Search
USPC ..... 347/54, 65, 68, 71, 72
See application file for complete search history.

(56) References Cited

U.S. PATENT DOCUMENTS

| | | | | |
|---|---|---|---|---|
| 6,783,214 | B2 * | 8/2004 | Sakuma | 347/72 |
| 7,611,229 | B2 * | 11/2009 | Hibi et al. | 347/68 |
| 7,661,802 | B2 | 2/2010 | Hara et al. | |
| 7,926,921 | B2 * | 4/2011 | Morita | 347/71 |
| 2006/0284936 | A1 | 12/2006 | Darling | |
| 2008/0084457 | A1 | 4/2008 | Hibi et al. | 347/70 |

FOREIGN PATENT DOCUMENTS

| | | | |
|---|---|---|---|
| EP | 1733886 | A2 | 12/2006 |
| EP | 1832424 | A1 | 9/2007 |
| JP | 2003-305852 | | 10/2003 |
| JP | 2008-094094 | | 4/2008 |
| WO | WO 2007/116699 | A1 | 10/2007 |

OTHER PUBLICATIONS

Extended European search report dated May 27, 2013 issued in corresponding European application 10780392.6.

* cited by examiner

*Primary Examiner* — Anh T. N. Vo
(74) *Attorney, Agent, or Firm* — DLA Piper LLP (US)

(57) ABSTRACT

A liquid discharge head through which discharged liquid droplets are easily gathered into one droplet, and a recording device using the head are provided. A liquid discharge head includes a liquid pressurizing chamber, a displacement element that applies pressure to the liquid pressurizing chamber, a liquid discharge hole, and a communication passage connecting the liquid pressurizing chamber and the liquid discharge hole. The communication passage includes a narrow portion having a small cross-section area and first and second communication passages. A ratio of lengths of the communication and second communication passages; a ratio of combined inertances of the liquid pressurizing chamber and the first communication passage and of the liquid discharge hole and the first communication passage; and a ratio of combined compliances of the liquid pressurizing chamber and the first communication passage and of the liquid discharge hole and the first communication passage fall within predetermined ranges.

4 Claims, 6 Drawing Sheets

LIQUID DISCHARGE HEAD AND RECORDING DEVICE USING SAME

CROSS-REFERENCE TO THE RELATED APPLICATIONS

This application is a national stage of international application No. PCT/JP2010/057356, filed on Apr. 26, 2010, and claims the benefit of priority under 35 USC 119 to Japanese Patent Application No. 2009-127537, filed on May 27, 2009, the entire contents of which are incorporate herein by reference.

TECHNICAL FIELD

The present invention relates to a liquid discharge head such as an inkjet recording head and a recording device using the same.

BACKGROUND ART

Recently printing devices, such as an inkjet printer and an inkjet plotter, in which an inkjet recording method is adopted, are widely used in not only printers for general consumers but also industrial applications such as formation of an electronic circuit, fabrication of a color filter for a liquid crystal display, and fabrication of an organic EL display.

A liquid discharge head that discharges a liquid is mounted as a printing head in the inkjet printing device. Generally a thermal type and a piezoelectric type are well known in this kind of printing head. In the thermal type, a heater that is of pressurizing means is included in an ink channel filled with ink, the ink is heated and boiled by the heater to generate a bubble in the ink channel, the ink is pressurized by the bubble, and the ink is discharged as a liquid droplet through an ink discharge hole. In the piezoelectric type, a wall of the ink channel filled with the ink is partially flexed and displaced by a displacement element, the ink in the ink channel is mechanically pressurized, and the ink is discharged as the liquid droplet through the ink discharge hole.

A serial type and a line type are also well known in the liquid discharge head. In the serial type, recording is performed while the liquid discharge head is moved in a direction orthogonal to a recording medium conveying direction. In the line type, the recording is performed to the recording medium conveyed in a sub-scanning direction, while the liquid discharge head that is longer than the recording medium in a main scanning direction is fixed, or while a plurality of liquid discharge heads are arrayed such that a recording range becomes wider than the recording medium. In the line type, it is not necessary to move the liquid discharge head unlike the serial type. Therefore, the line type has an advantage that high-speed recording can be performed.

In both the serial type liquid discharge head and the line type liquid discharge head, it is necessary to increase density of the liquid discharge hole, which is formed in the liquid discharge head to discharge the liquid droplet, in order to perform high-density recording.

Therefore, there is well known a liquid discharge head that is configured to stack a manifold, a flow channel member, and an actuator unit (for example, see Patent Document 1). The flow channel member includes an individual flow channel that connects the manifold and the liquid discharge hole through a common flow channel, a throttle, a liquid pressurizing chamber, and a communication passage. The actuator unit includes a plurality of displacement elements each of which is provided such that the liquid pressurizing chamber is covered therewith. In the liquid discharge head of Patent Document 1, a corns-section area of the communication passage is kept constant. The liquid pressurizing chambers that are connected to the plurality of liquid discharge holes are disposed in a matrix array, and the displacement element is provided in the actuator unit such that the liquid pressurizing chamber is covered therewith. The displacement element is displaced to discharge the liquid droplet through the liquid discharge hole connected to each liquid pressurizing chamber, and printing can be performed with resolution of 600 dpi in the main scanning direction. The flow channel member is made by stacking a plurality of metallic plates. In the piezoelectric actuator, a piezoelectric ceramic layer, a common electrode, a piezoelectric ceramic layer, and an individual electrode are sequentially stacked from the flow channel member side.

PRIOR ART DOCUMENT

Patent Document

Patent Document 1: Japanese Unexamined Patent Publication No. 2003-305852

SUMMARY OF THE INVENTION

Problems to be Solved by the Invention

In the liquid discharge head described in Patent Document 1, the liquid droplet that is discharged in a one-time discharge operation does not become one droplet (hereinafter referred to as divided droplets), and a plurality of liquid droplets land in the recording medium, thereby sometimes degrading recording accuracy. Particularly, when a discharge speed of the liquid droplet is enhanced or when ultraviolet curable ink having viscosity higher than that aqueous ink is discharged, the divided droplets are generated.

An object of the invention is to provide a liquid discharge head, in which the divided droplets are not generated, the liquid droplets easily land in the recording medium so as to become one pixel even if the divided droplets are generated, or the discharged liquid droplets are easily gathered into one droplet, and a recording device in which the liquid discharge head is used.

Means for Solving the Problems

A liquid discharge head of the invention comprises: a liquid pressurizing chamber, a pressurizing unit that applies a pressure to the liquid pressurizing chamber, a liquid discharge hole, and a communication passage that connects the liquid pressurizing chamber and the liquid discharge hole. The communication passage comprises a narrow portion having a small cross-section area, a first communication passage defined by a portion between a connection end to the liquid pressurizing chamber and a connection end to the narrow portion, and a second communication passage defined by a portion between a connection end to the liquid discharge hole and the connection end to the narrow portion; a cross-section area of the narrow portion is 0.7 time or less of a cross-section area of the first communication passage, and is 0.7 time or less of a cross-section area of the second communication passage; and $0.2 \leqq Ld2/Ld0 \leqq 0.4$, $0.17 \leqq M2/M1 \leqq 0.25$, and $0.18 \leqq C2/C1 \leqq 0.23$ are satisfied where Ld0 (m) is a length of the communication passage, Ld2 (m) is a length of the second communication passage, M1 ($kg/m^4$) is a combined inertance of the liquid pressurizing chamber and the first communication passage, C1 ($m^5/N$) is a combined compliance of the liquid pressurizing chamber and the first communication passage, M2 ($kg/m^4$) is combined inertance of the liquid discharge hole and the second communication passage, and C2 ($m^5/N$) is combined compliance of the liquid discharge hole and the second communication passage.

Preferably $0.1 \leqq Ld3/Ld0 \leqq 0.15$ is satisfied, where Ld3 (m) is a length of the narrow portion.

Further preferably the cross-section area of the narrow portion is 0.3 time or more of the cross-section area of the first communication passage, and is 0.3 time or more of the cross-section area of the second communication passage.

A recording device of the invention comprises: the liquid discharge head; a conveying unit that conveys a recording medium to the liquid discharge head; and a control unit controlling drive of the liquid discharge head.

Effect of the Invention

According to the liquid discharge head of the invention, even in the case of the high flow rates (high inertance) of the liquid pressurizing chamber and the communication passage, the narrow portion is provided in the communication passage to decrease the inertance in the communication passage, which allows the pressure oscillation to be damped in the flow channel. The excess pressure oscillation is decreased, the divided droplets caused by the excess pressure oscillation is hardly generated, and the discharged liquid droplets become one droplet, the discharged liquid droplets are gathered into one droplet during flight, or the discharged liquid droplets easily land so as to become one pixel even if the liquid droplets are not gathered. Therefore, the good image can be recorded.

EMBODIMENTS FOR CARRYING OUT THE INVENTION

Figure 1:
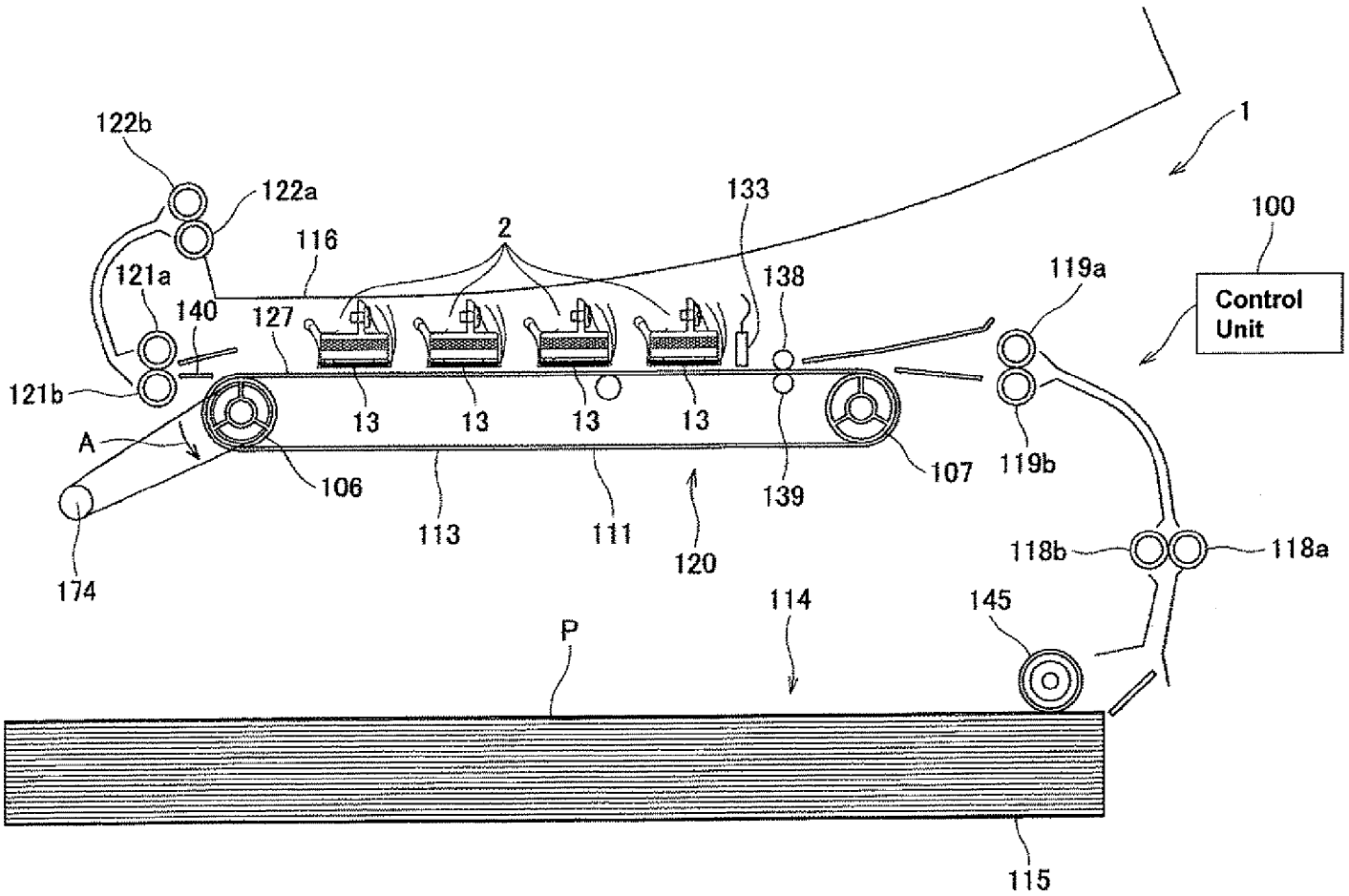
FIG. 1 is a schematic configuration view illustrating a printer that is of an example of a recording device.

FIG. 1 is a schematic configuration view for illustrating a color inkjet printer that is of an example of a recording device. A color inkjet printer 1 (hereinafter referred to as a printer 1) includes four liquid discharge heads 2. The liquid discharge heads 2 are arrayed in a conveying direction of a recording sheet P that is of the recording medium, and the liquid discharge heads 2 are fixed to the printer 1. The liquid discharge head 2 has a long and thin shape in a direction from a front side of FIG. 1 toward the back.

In the printer 1, a sheet feed unit 114, a conveying unit 120, and a sheet receiving unit 116 are sequentially provided along a conveying route of the recording sheet P. A controller 100 is provided in the printer 1 in order to control operations of units such as the liquid discharge head 2 and the sheet feed unit 114.

The sheet feed unit 114 includes a sheet storage case 115 in which a plurality of recording sheets P can be stored and a sheet feed roller 145. The sheet feed roller 145 can individually feed the topmost recording sheet P of the recording sheets P that are stacked and stored in the sheet storage case 115.

Two pairs of feed rollers 118*a* and 118*b* and 119*a* and 119*b* are disposed between the sheet feed unit 114 and the conveying unit 120 along the conveying route of the recording sheet P. The recording sheet P fed from the sheet feed unit 114 is fed to the conveying unit 120 while guided by the feed rollers 118*a*, 118*b*, 119*a*, and 119*b*.

The conveying unit 120 includes an endless conveying belt 111 and two belt rollers 106 and 107. The conveying belt 111 is entrained about the belt rollers 106 and 107. The conveying belt 111 is adjusted to a predetermined length at which the conveying belt 111 is tensioned when entrained about the belt rollers 106 and 107. Therefore, the conveying belt 111 is tensioned without relaxation along two planes, which are parallel to each other while including common tangents of the belt rollers 106 and 107. In the two planes, the plane closer to the liquid discharge head 2 is a conveying surface 127 that conveys the recording sheet P.

As illustrated in FIG. 1, a conveying motor 174 is connected to the belt roller 106. The conveying motor 174 can rotate the belt roller 106 in a direction of an arrow A. The belt roller 107 can be rotated in conjunction with the conveying belt 111. The conveying motor 174 is driven to rotate the belt roller 106, whereby the conveying belt 111 is moved along the direction of the arrow A.

A nip roller 138 and a nip receiving roller 139 are disposed near the belt roller 107 so as to nip the conveying belt 111. The nip roller 138 is biased downward by a spring (not illustrated). The nip receiving roller 139 located below the nip roller 138 receives the downwardly-biased nip roller 138 with the conveying belt 111 interposed therebetween. The two nip rollers are rotatably placed and rotated in conjunction with the conveying belt 111.

The recording sheet P that is fed from the sheet feed unit 114 to the conveying unit 120 is nipped between the nip roller 138 and the conveying belt 111. Therefore, the recording sheet P is pressed against the conveying surface 127 of the conveying belt 111, and fixed to the conveying surface 127. The recording sheet P is conveyed in the direction, in which the liquid discharge head 2 is placed, according to the rotation of the conveying belt 111. An outer circumferential surface 113 of the conveying belt 111 may be coated with adhesive silicon rubber. Therefore, the recording sheet P can securely be fixed to the conveying surface 127.

The four liquid discharge heads 2 are disposed while brought close to one another along the conveying direction of the conveying belt 111. Each liquid discharge head 2 includes a head body 13 at a lower end thereof. Many liquid discharge holes 8 that discharge liquids are provided in a lower surface of the head body 132 (see FIG. 3).

The liquid droplets (ink) of the same color are discharged from the liquid discharge holes 8 provided in one liquid discharge head 2. The liquid discharge holes 8 of each liquid discharge head 2 are disposed at equal intervals in one direction (that is parallel to the recording sheet P and is a direction orthogonal to the conveying direction of the recording sheet P, namely, a lengthwise direction of the liquid discharge head 2), so that the recoding can be performed without a gap in one direction. The colors of the liquids discharged from the liquid discharge heads 2 are magenta (M), yellow (Y), cyan (C), and black (K). Each liquid discharge head 2 is disposed with a slight gap between the lower surface of the head body 13 and the conveying surface 127 of the conveying belt 111.

The recording sheet P conveyed by the conveying belt 111 passes through the gap with the conveying belt 111 on the lower surface side of the liquid discharge head 2. At this point, the liquid droplet is discharged toward an upper surface of the recording sheet P from the head body 13 constituting the liquid discharge head 2. Therefore, a color image is formed in the upper surface of the recording sheet P based on image data stored by the controller 100.

A peel-off plate 140 and two pairs of feed rollers 121*a* and 121*b* and 122*a* and 122*b* are disposed between the conveying unit 120 and the sheet receiving unit 116. The recording sheet P in which the color image is recorded is conveyed from the conveying belt 111 to the peel-off plate 140. At this point, the recording sheet P is peeled off from the conveying surface 127 by a right end of the peel-off plate 140. The recording sheet P is fed to the sheet receiving unit 116 by the feed rollers 121*a*, 121*b*, 122*a*, and 122*b*. Thus, the already-recorded recording sheets P are sequentially fed to and stacked on the sheet receiving unit 116.

A sheet surface sensor 133 is placed between the nip roller 138 and the liquid discharge head 2 that is located on the most upstream side in the conveying direction of the recording sheet P. The sheet surface sensor 133 includes a light emitting element and the light receiving element to be able to detect a leading-end position of the recording sheet P on the conveying route. A detection result of the sheet surface sensor 133 is transmitted to the controller 100. The controller 100 can control the liquid discharge head 2 and the conveying motor 174 according to the detection result transmitted from the sheet surface sensor 133 such that the conveyance of the recording sheet P is synchronized with the recording of the image.

Figure 2:
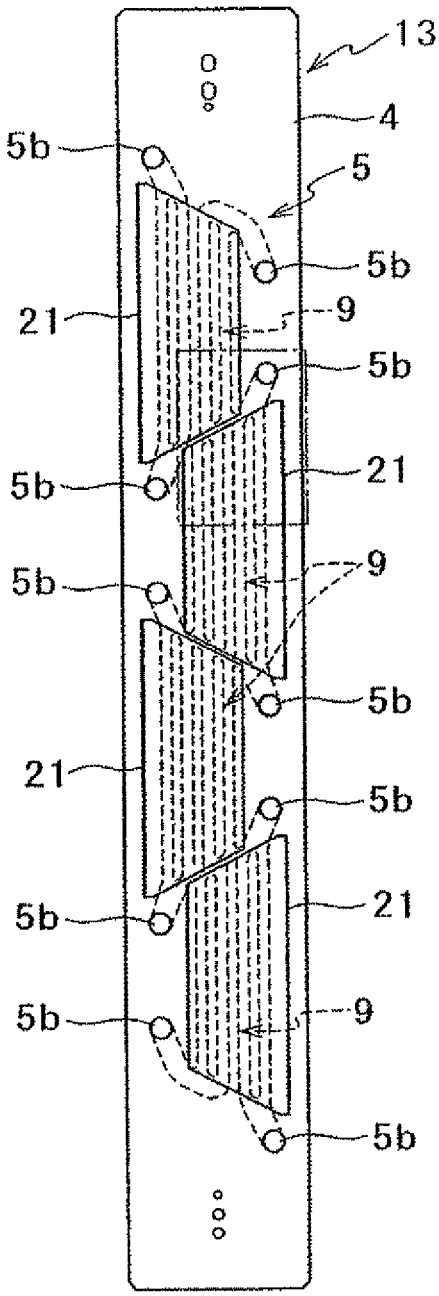
FIG. 2 is a plan view illustrating a head body constituting a liquid discharge head of FIG. 1.
Figure 3:
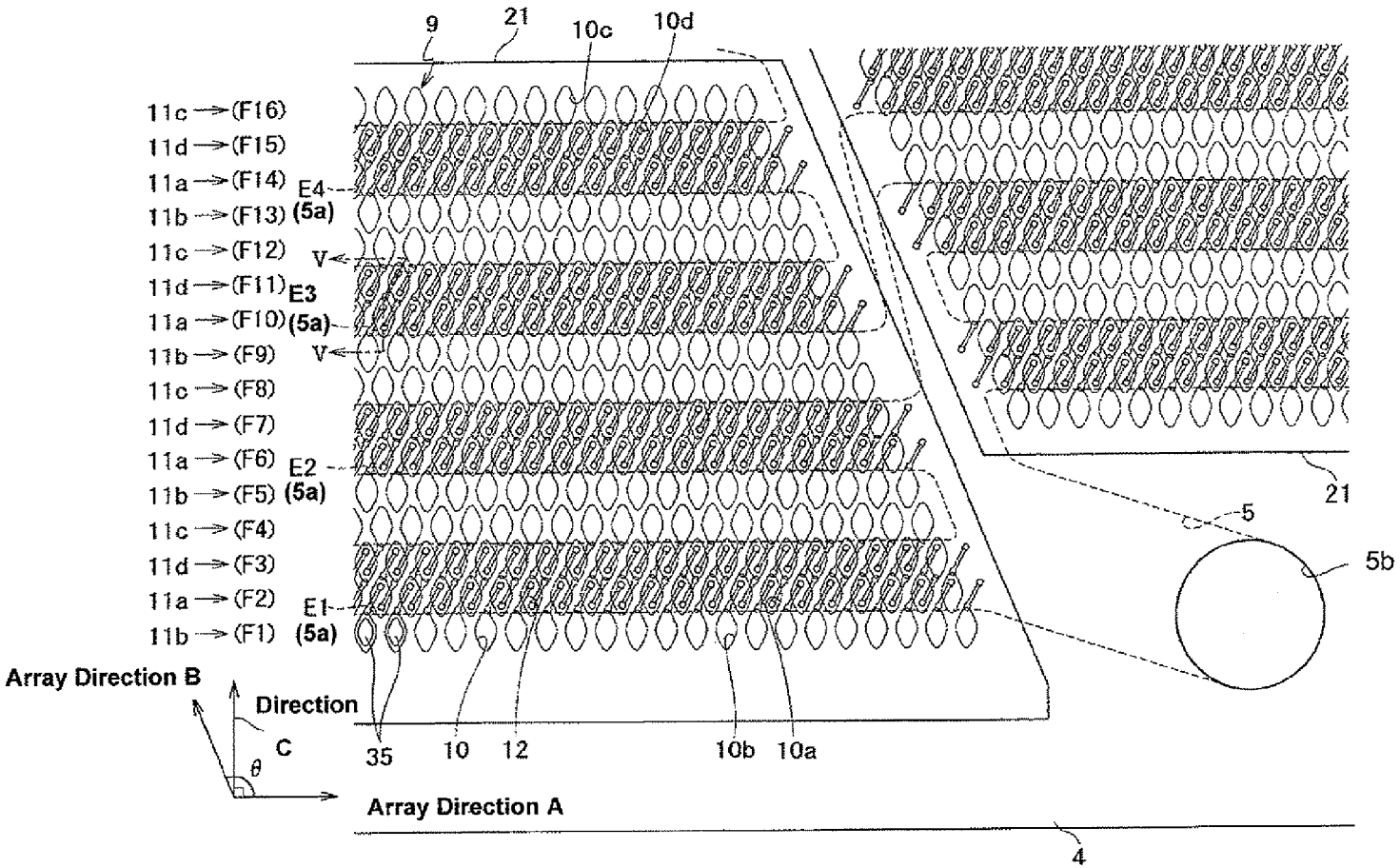
FIG. 3 is an enlarged view of a region surrounded by an alternate long and short dash line of FIG. 2.
Figure 4:
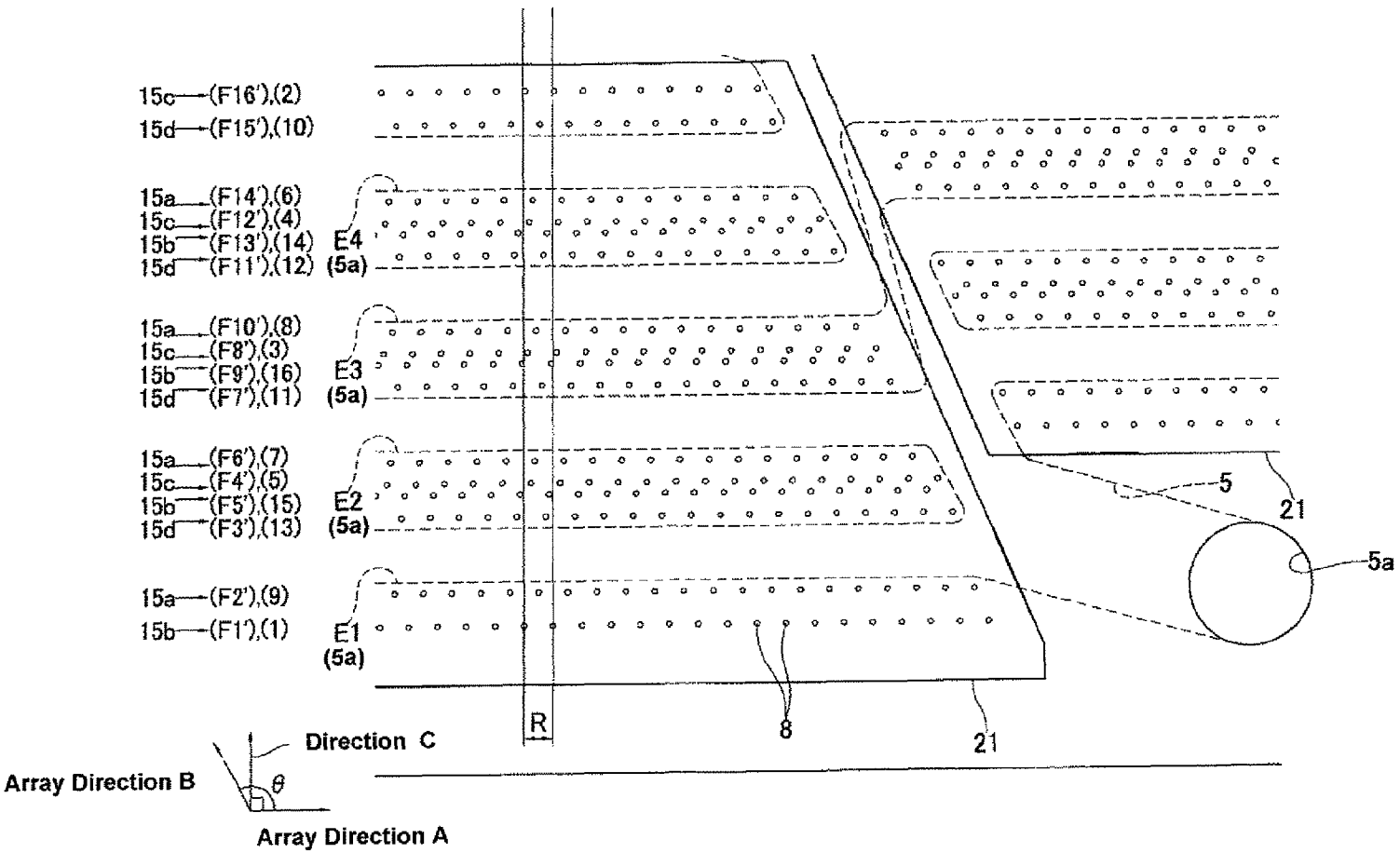
FIG. 4 is an enlarged view of the region surrounded by the alternate long and short dash line of FIG. 2, and a flow channel is partially omitted for illustrative purpose.
Figure 5:
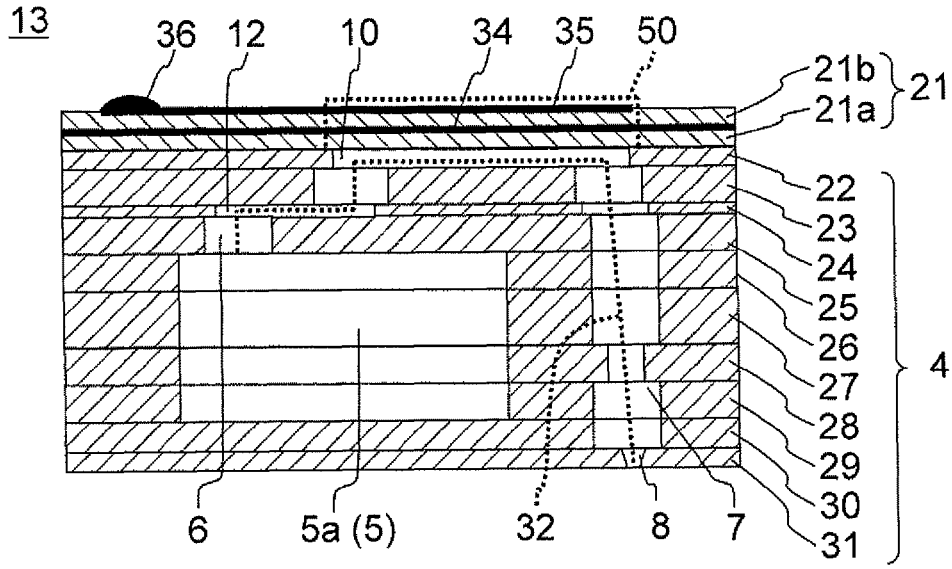
FIG. 5(*a*) is a vertical sectional view taken on a line V-V of FIG. 3, and FIG. 5(*b*) is a vertical sectional view of a communication passage that is of part of FIG. 5(*a*).
Figure 5:
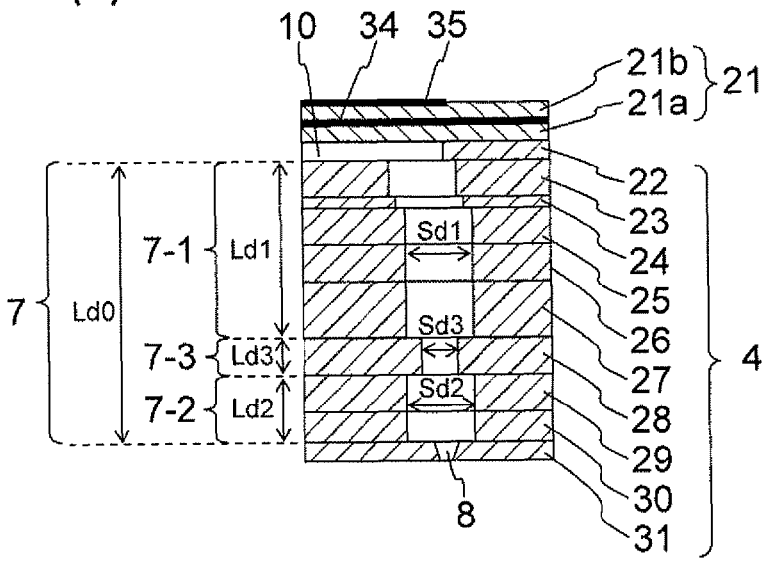

A head body 13 constituting the liquid discharge head 2 will be described below. FIG. 2 is a plan view illustrating the head body 13 of FIG. 1. FIG. 3 is an enlarged view of a region surrounded by an alternate long and short dash line of FIG. 2, and part of the head body 13. FIG. 4 is an enlarged perspective view in the same position as that of FIG. 3, and a view in which a flow channel is partially omitted such that a position of a liquid discharge hole 8 is easy to be seen. For the sake of easy understanding, a liquid pressurizing chamber 10 (liquid pressurizing chamber group 9), a throttle 12, and the liquid discharge hole 8, which are located below a piezoelectric actuator unit 21 and should be drawn by a broken line, are drawn by a solid line in FIGS. 3 and 4. FIG. 5(*a*) is a vertical sectional view taken on a line V-V of FIG. 3, and FIG. 5(*b*) is a vertical sectional view of a communication passage that is of part of FIG. 5(*a*).

The head body 13 includes a plate-like flow channel member 4 and the piezoelectric actuator unit 21 that is of the actuator unit disposed on, the flow channel member 4. The piezoelectric actuator unit 21 has a trapezoidal shape, and is disposed on the upper surface of the flow channel member 4 such that a pair of parallel sides of the trapezoidal shape becomes parallel to the lengthwise direction of the flow channel member 4. Along each of two virtual straight lines parallel to the lengthwise direction of the flow channel member 4, each two of the piezoelectric actuator units 21, namely, a total of four piezoelectric actuator units 21 are arrayed on the flow channel member 4 in a zigzag manner as a whole. In the piezoelectric actuator units 21 adjacent to each other on the flow channel member 4, oblique sides partly overlap each other when the flow channel member 4 is viewed in a crosswise direction. In a region where the recording is performed by driving the piezoelectric actuator units 21 in the overlapping portion, the liquid droplets discharged from the two piezoelectric actuator units 21 land while being mixed each other.

A manifold 5 that is of part of the liquid flow channel is formed in the flow channel member 4. The manifold 5 has a long and thin shape that extends along the lengthwise direction of the flow channel member 4, and an opening 5*b* of the manifold 5 is formed in the upper surface of the flow channel member 4. Each five of openings 5*b* are formed along each of two straight lines (virtual line) parallel to the lengthwise direction of the flow channel member 4, namely, the total of ten openings 5*b* are formed along the two straight lines. The openings 5*b* are formed in positions so as to avoid the region where the four piezoelectric actuator units 21 are disposed. A liquid is supplied to the manifold 5 from a liquid tank (not illustrated) through the opening 5*b*.

The manifold 5 formed in the flow channel member 4 is branched into a plurality of lines (sometimes the manifold 5 in the branched portion is referred to as a sub-manifold 5*a*). The manifold 5 connected to the opening 5*b* extends along the oblique side of the piezoelectric actuator unit 21, and the manifold 5 is disposed while intersecting the lengthwise direction of the flow channel member 4. In the region sandwiched between the two piezoelectric actuator units 21, one manifold 5 is shared by the piezoelectric actuator units 21 adjacent to each other, and the sub-manifolds 5*a* branch from both sides of the manifold 5. The sub-manifolds 5*a* extend in the lengthwise direction of the head body 13 while being adjacent to the region opposite to the piezoelectric actuator units 21 in the flow channel member 4.

The flow channel member 4 includes the four liquid pressurizing chamber groups 9, in each of which the plurality of liquid pressurizing chambers 10 are disposed in the matrix array (that is, two-dimensionally and regularly). The liquid pressurizing chamber 10 is a hollow region having a substantially-rhombic planar shape whose corner portions are rounded. The liquid pressurizing chamber 10 is formed so as to be opened in the upper surface of the flow channel member 4. The liquid pressurizing chambers 10 are arrayed in the substantially whole surface of the region opposite to the piezoelectric actuator unit 21 in the upper surface of the flow channel member 4. Accordingly, each liquid pressurizing chamber group 9 including the liquid pressurizing chambers 10 occupies the region having the substantially same size and shape as the piezoelectric actuator unit 21. The opening of each liquid pressurizing chamber 10 is closed by bonding the piezoelectric actuator unit 21 to the upper surface of the flow channel member 4.

In the embodiment, as illustrated in FIG. 3, the manifold 5 is branched into sub-manifolds 5*a* of four lines E1 to E4 that are parallel to one another in the crosswise direction of the flow channel member 4, the liquid pressurizing chambers 10 connected to the sub-manifolds 5*a* constitute the line of the liquid pressurizing chambers 10 that are arrayed at equal intervals in the lengthwise direction of the flow channel member 4, and the four lines of the liquid pressurizing chambers 10 are arrayed in parallel to one another in the crosswise direction. Each two of the lines in which the liquid pressurizing chambers 10 connected to the sub-manifolds 5*a* are arrayed are disposed on both sides of the sub-manifolds 5*a*.

In total, the liquid pressurizing chambers 10 connected from the manifold 5 constitute the line of the liquid pressurizing chambers 10 that are arrayed at equal intervals in the lengthwise direction of the flow channel member 4, and the 16 lines of the liquid pressurizing chambers 10 are arrayed in parallel to one another in the crosswise direction. The number of liquid pressurizing chambers 10 included in each liquid pressurizing chamber line is gradually decreased from a long side toward a short side of a displacement element 50 according to an outline shape of the displacement element 50 that is of the actuator. The liquid discharge holes 8 are disposed in the same manner. Therefore, the image can be formed with resolution of 600 dpi in the lengthwise direction as a whole.

When the liquid discharge holes 8 are projected so as to be orthogonal to the virtual straight line parallel to the lengthwise direction of the flow channel member 4, the 4 liquid discharge holes 8 connected to each of the 4 sub-manifolds 5*a*, namely, the total of 16 liquid discharge holes 8 are disposed at equal intervals corresponding to 600 dpi in a range of R of the virtual straight line illustrated in FIG. 3. An individual flow channel 32 is averagely connected to each sub-manifold 5*a* at intervals corresponding to 150 dpi. When the liquid discharge holes 8 of 600 dpi are designed to be connected while divided into the four lines of the sub-manifolds 5*a*, because the individual flow channels 32 are not always connected to the sub-manifolds 5*a* at equal intervals, the individual flow channels 32 are formed at average intervals of about 170 μm (interval of 25.4 mm/150=169 μm in the case of 150 dpi) or less in the extending direction of the manifold 5*a*, namely, the main scanning direction.

An individual electrode 35 is formed opposite each liquid pressurizing chamber 10 in the upper surface of the piezoelectric actuator unit 21. The individual electrode 35 is smaller than the liquid pressurizing chamber 10, and has a shape that is substantially similar to that of the liquid pressurizing chamber 10. The individual electrode 35 is disposed so as to be accommodated in the region opposite to the liquid pressurizing chamber 10 in the upper surface of the piezoelectric actuator unit 21.

Many liquid discharge holes 8 are formed in a liquid discharge surface in the lower surface of the flow channel member 4. The liquid discharge holes 8 are disposed so as to avoid the region opposite to the sub-manifold 5*a* disposed on the lower surface side of the flow channel member 4. The liquid discharge holes 8 are disposed in the region opposite to the piezoelectric actuator unit 21 on the lower surface side of the flow channel member 4. A liquid discharge hole group 7 occupies the region having the substantially same size and shape as the piezoelectric actuator unit 21, and the liquid droplet can be discharged from the liquid discharge hole 8 by displacing the displacement element 50 of the corresponding piezoelectric actuator unit 21. The disposition of the liquid discharge hole 8 is described later. The liquid discharge holes 8 in each region are arrayed at equal intervals along the plurality of straight lines parallel to the lengthwise direction of the flow channel member 4.

The flow channel member 4 constituting the head body 13 has a stacked structure in which a plurality of plates are stacked. The plates include, in order from the upper surface of the flow channel member 4, a cavity plate 22, a base plate 23, an aperture (throttle) plate 24, a supply plate 25, manifold plates 26, 27, 28, and 29, a cover plate 30, and a nozzle plate 31. Many holes are made in these plates. The plates are aligned and stacked such that the holes are communicated with one another to constitute the individual flow channel 32 and the sub-manifold 5*a*. In the configuration of the head body 13, as illustrated in FIG. 5, portions constituting the individual flow channel 32 are provided in different positions while brought close to one another, such that the liquid pressurizing chamber 10 is disposed in the upper surface of the flow channel member 4, such that the sub-manifold 5*a* is disposed on the lower surface side in the flow channel member 4, and such that the liquid discharge hole 8 is disposed in the lower surface of the flow channel member 4, and the sub-manifold 5*a* and the liquid discharge hole 8 are connected through the liquid pressurizing chamber 10.

The hole made in each plate will be described. The following holes are made. The first hole is the liquid pressurizing chamber 10 formed in the cavity plate 22. The second holes is a communication hole constituting the flow channel connected from one end of the liquid pressurizing chamber 10 to the sub-manifold 5*a*. The communication hole is made in each of the plates from the base plate 23 (particularly, an entrance of the liquid pressurizing chamber 10) to the supply plate 25 (particularly, an exit of the sub-manifold 5*a*). The communication hole includes the throttle 12 formed in the aperture plate 24 and the individual supply flow channel 6 formed in the supply plate 25.

The third hole is a communication hole constituting a communication passage communicated from the other end of the liquid pressurizing chamber 10 to the liquid discharge hole 8, and the communication passage includes the liquid discharge hole 8 and a portion that is called a descender (partial flow channel) 7 in the following description. The descender 7 is formed in each of the plates from the base plate 23 (particularly, an exit of the liquid pressurizing chamber 10) to the cover plate 30 (particularly, an connection end to the liquid discharge hole 8). The descender 7 includes a first descender (first communication passage) 7-1 from the base plate 23 (particularly, the exit of the liquid pressurizing chamber 10) to the manifold plate 27, a second descender (second communication passage) 7-2 from the manifold plate 29 to the cover plate 30, and a narrow portion 7-3. The narrow portion 7-3 connects the first descender 7-1 and the second descender 7-2, and a cross section of the narrow portion 7-3 is narrowed such that a cross-section area of the narrow portion 7-3 is 70% or less of a cross-section area of the first descender 7-1 and such that the cross-section area of the narrow portion 7-3 is 70% or less of a cross-section area of the second descender 7-2.

The fourth hole is a communication hole constituting the sub-manifold 5*a*. The communication hole is made in the manifold plates 25 to 29.

The communication holes are connected to one another to constitute the individual flow channel 32 from an inflow port (the exit of the sub-manifold 5*a*) of the liquid from the sub-manifold 5*a* to the liquid discharge hole 8. The liquid supplied to the sub-manifold 5*a* is discharged from the liquid discharge hole 8 through the following route. The liquid is oriented upward from the sub-manifold 5*a* to pass through the individual supply flow channel 6, and the liquid reaches one end portion of the throttle 12. Then the liquid proceeds horizontally along the extending direction of the throttle 12, and reaches the other end portion of the throttle 12. The liquid is oriented upward to reach one end portion of the liquid pressurizing chamber 10. The liquid proceeds horizontally along the extending direction of the liquid pressurizing chamber 10, and reaches the other end portion of the liquid pressurizing chamber 10. The liquid is mainly oriented downward while horizontally moved little by little in the descender 7, and the liquid proceeds to the liquid discharge hole 8 whose lower surface is opened.

As illustrated in FIG. 5, the piezoelectric actuator unit 21 has a stacked structure including two piezoelectric ceramic layers 21*a* and 21*b*. Each of the piezoelectric ceramic layers 21*a* and 21*b* has a thickness of about 20 μm. The whole thickness of the piezoelectric actuator unit 21 is about 40 μm. Each of the piezoelectric ceramic layers 21*a* and 21*b* extends so as to stride over the plurality of liquid pressurizing chambers 10 (see FIG. 3). The piezoelectric ceramic layers 21*a* and

21*b* are made of a lead zirconium titanate (PZT) ceramic material having a ferroelectricity.

For example, the piezoelectric actuator unit 21 and the flow channel member 4 are bonded with a bonding layer interposed therebetween. A bonding agent made of at least one kind of a thermosetting resin selected from a group consisting of an epoxy resin, a phenol resin, and a polyphenylene ether resin, which have a thermal curing temperature of 100 to 150° C., is used as the bonding layer in order not to affect the piezoelectric actuator unit 21 and the flow channel member 4. The reason the bonding agent made of the thermosetting resin is used is that possibly an ink-resistant property is insufficiently ensured in a bonding agent cured at room temperature. Therefore, because the piezoelectric actuator unit 21 is cooled from the thermal curing temperature to room temperature, a stress generated by a difference of thermal expansion coefficient between the flow channel member 4 and the piezoelectric actuator unit 21 is applied to the piezoelectric actuator unit 21. In the case of the large stress, there is a risk that the piezoelectric actuator unit 21 is broken. Even if the stress is not enough to break the piezoelectric actuator unit 21, a characteristic of the piezoelectric actuator unit 21 varies by the applied stress. Specifically, when a compressive stress is applied, a piezoelectric constant is decreased, and an influence of a phenomenon called operating degradation, in which a displacement amount is decreased when the operation is repeated for an extremely long time, is reduced. When a tensile stress is applied, the operating degradation is highly influenced while the piezoelectric constant is increased. When the compressive stress is weakly applied, the influence of the operating degradation is reduced, and the variation of the discharge characteristic is decreased even in the long-term use. In the case that the PZT ceramic material is used in the piezoelectric actuator unit 21, a 42 alloy is used as the material for the flow channel member 4, which allows the weak compressive stress to be applied to the piezoelectric actuator unit 21.

The piezoelectric actuator unit 21 includes a common electrode 34 made of a metallic material such as a Ag—Pd system and the individual electrode 35 made of a metallic material such as a Au system. As described above, the individual electrode 35 is disposed opposite the liquid pressurizing chamber 10 in the upper surface of the piezoelectric actuator unit 21. One end of the individual electrode 35 is extracted to the outside of the region opposite to the liquid pressurizing chamber 10 to form a connection electrode 36. For example, the connection electrode 36 is made of gold containing glass frit, and the connection electrode 36 is formed into a convex shape while having the thickness of about 15 μm. The connection electrode 36 is electrically connected to an electrode provided in FPC (Flexible Printed Circuit) (not illustrated). Although the detailed description is made later, a drive signal is supplied to the individual electrode 35 from the control unit 100 through the FPC. The drive signal is supplied with a constant period in synchronization with a conveying speed of the recording sheet P.

In the region between the piezoelectric ceramic layers 21*a* and 21*b*, the common electrode 34 is formed in the substantially whole surface in a planar direction. That is, the common electrode 34 extends in the region opposite to the piezoelectric actuator unit 21 such that all the liquid pressurizing chambers 10 are covered therewith. The common electrode 34 has the thickness of about 2 μm. The common electrode 34 is grounded in a region (not illustrated) and kept at a ground potential. In the embodiment, on the piezoelectric ceramic layer 21*b*, a surface electrode (not illustrated) different from the individual electrode 35 is formed so as to avoid an electrode group including the individual electrodes 35. The surface electrode is electrically connected to the common electrode 34 through a through-hole made in the piezoelectric ceramic layer 21*b*, and the surface electrode is connected to another electrode on the FPC similarly to the many individual electrodes 35.

As illustrated in FIG. 5, the common electrode 34 and the individual electrode 35 are disposed such that only the piezoelectric ceramic layer 21*b* of the uppermost layer is sandwiched therebetween. In the piezoelectric ceramic layer 21*b*, the region that is sandwiched between the individual electrode 35 and the common electrode 34 is called an active portion, and polarization is performed to the piezoelectric ceramic of the active portion. In the piezoelectric actuator unit 21 of the embodiment, the piezoelectric ceramic layer 21*a* does not include the active portion, but only the piezoelectric ceramic layer 21*b* of the uppermost layer includes the active portion, and acts as the diaphragm. The piezoelectric actuator unit 21 has a configuration of a what is called a unimorph type.

The predetermined drive signal is selectively supplied to the individual electrode 35 to pressurize the liquid in the liquid pressurizing chamber 10 corresponding to the individual electrode 35. Therefore, the liquid droplet is discharged from the corresponding liquid discharge hole 8 through the individual flow channel 32. That is, the portion opposite to each liquid pressurizing chamber 10 in the piezoelectric actuator unit 21 is equivalent to the individual displacement element 50 (actuator, pressurizing portion) corresponding to each liquid pressurizing chamber 10 and the liquid discharge hole 8. In the stacked body including the piezoelectric ceramic layers 21*a* and 21*b*, the displacement element 50 having the structure illustrated in FIG. 5 as a unit structure is formed in each liquid pressurizing chamber 10 by the piezoelectric ceramic layer (diaphragm) 21*a*, the common electrode 34, the piezoelectric ceramic layer 21*b*, and the individual electrode 35, which are located immediately above the liquid pressurizing chamber 10, and the plurality of displacement elements 50 are included in the piezoelectric actuator unit 21. In the embodiment, an amount of liquid discharged from the liquid discharge hole 8 by the one-time discharge operation ranges from 5 to 7 pL (picoliter).

Each of the many individual electrodes 35 is electrically connected to the control unit 100, which individually controls the actuator, through wiring in the FPC such that the potential can individually be controlled.

In the piezoelectric actuator unit 21 of the embodiment, when the individual electrode 35 is set to the potential different from that of the common electrode 34 to apply an electric field to the piezoelectric ceramic layer 21*b* in the polarization direction, the portion to which the electric field is applied acts as the active portion that is strained by a piezoelectric effect. At this point, the piezoelectric ceramic layer 21*b* expands or contracts in the thickness direction, namely the stacked direction, and the piezoelectric ceramic layer 21*b* contracts or expands in the direction perpendicular to the stacked direction, namely, the planar direction by a piezoelectric transverse effect. On the other hand, because the remaining piezoelectric ceramic layer 21*a* is the non-active layer that does not have the region sandwiched between the individual electrode 35 and the common electrode 34, the piezoelectric ceramic layer 21*a* is not spontaneously deformed. That is, the piezoelectric actuator unit 21 has the configuration of what is called the unimorph type, in which the piezoelectric ceramic layer 21*b* on the upper side (that is, the side farther away from the liquid pressurizing chamber 10) is used as the layer including the active portion while the piezoelectric ceramic layer 21*a* on the lower side (that is, the side closer to the liquid pressurizing chamber 10) is used as the non-active layer.

In the configuration, when the control unit 100 sets the individual electrode 35 to a positive or negative predetermined potential with respect to the common electrode 34 such that the electric field and the polarization become the same direction, the portion (active portion) of the piezoelectric ceramic layer 21*b*, which is sandwiched between the individual electrode 35 and the common electrode 34, contracts in the planar direction. On the other hand, because the piezoelectric ceramic layer 21*a* of the non-active layer is not affected by the electric field, the piezoelectric ceramic layer 21 does not spontaneously contract, but regulates the deformation of the active portion. As a result, a difference of strain in the polarization direction is generated between the piezoelectric ceramic layers 21*b* and 21*a*, and the piezoelectric ceramic layer 21*b* is deformed so as to become convex onto the side of the liquid pressurizing chamber 10 (unimorph deformation).

In an actual drive procedure of the embodiment, the individual electrode 35 is previously set to the potential higher than that of the common electrode 34 (hereinafter referred to as high potential), the individual electrode 35 is tentatively set to the same potential as the common electrode 34 (hereinafter referred to as low potential) in each discharge request, and then the individual electrode 35 is set to the high potential at a predetermined time. Therefore, the piezoelectric ceramic layers 21*a* and 21*b* return to the original shape at the time when the individual electrode 35 becomes the low potential, and a volume of the liquid pressurizing chamber 10 is increased compared with an initial state (individual electrode 35 differs from the common electrode 34 in the potential). At this point, a negative pressure is provided into the liquid pressurizing chamber 10, and the liquid is sucked into the liquid pressurizing chamber 10 from the side of the manifold 5. Then, at the time when the individual electrode 35 is set to the high potential again, the piezoelectric ceramic layers 21*a* and 21*b* is deformed so as to become convex onto the side of the liquid pressurizing chamber 10, the liquid pressurizing chamber 10 becomes a positive pressure by the decrease in volume of the liquid pressurizing chamber 10, and the pressure applied to the liquid is increased to discharge the liquid droplet. That is, the drive signal that includes a pulse based on the high potential is supplied to the individual electrode 35 in order to discharge the liquid droplet. A pulse width is set to an AL (Acoustic Length) that is of a time length in which a pressure wave in the liquid pressurizing chamber 10 propagates from the manifold 5 to the liquid discharge hole 8, which allows a discharge speed of the liquid droplet to be enhanced. This is because the liquid droplet is discharged while the stronger pressure wave is formed by combining the pressure wave reflected from the throttle 12 and the pressure wave, which is generated in such a manner that the piezoelectric ceramic layers 21*a* and 21*b* are deformed so as to becomes convex onto the side of the liquid pressurizing chamber 10.

In the case of gray-scale recording, the gray-scale expression is performed by the amount of liquid droplet that is adjusted by the number of liquid droplets discharged continuously from the liquid discharge hole 8, namely, the number of discharge times of the liquid droplet. Therefore, the liquid droplet discharge corresponding to the number of times corresponding to the specified gray-scale expression is continuously performed from the liquid discharge hole 8 corresponding to the specified dot region. In the case that the liquid droplet is continuously discharged, an interval between the pulses supplied to discharge the liquid droplet is set to the AL, the timing of the pressure wave that remains after the preceding liquid droplet is discharged is matched with the timing of the pressure wave generated in discharging the subsequent liquid droplet, and the pressure waves are superimposed to discharge the liquid droplet, which allows the pressure to be amplified.

In the printer 1, the image can be recorded with the resolution of 600 dpi in the lengthwise direction and 600 dpi in the conveying direction by adjusting the conveying speed of the recording sheet P and the period of the drive signal. For example, when the drive signal is set to a frequency of 20 kHz and the conveying speed of 0.85 m/s, the discharged liquid droplet can land in the recording sheet P in each of about 42 μm in the conveying direction. Therefore, the resolution becomes 600 dpi in the conveying direction.

The state of the liquid in the individual flow channel 32 in discharging the liquid droplet will be described in detail. As described above, when the discharge operation is performed, the pressure applied to the displacement element 50 propagates to the liquid discharge hole 8 from the liquid pressurizing chamber 10 through the descender (communication passage) 7, the liquid is discharged as a liquid column from the liquid discharge hole 8, the liquid column becomes the liquid droplet, and the liquid droplet flies. Although one liquid droplet is discharged by the pressure in the ideal state, actually various oscillations are generated by the pressure in the liquid of the descender 7. Therefore, sometimes the liquid column does not become one liquid droplet due to the oscillations, but the divided droplets are generated. The divided droplets are easily generated when the high pressure is applied to the liquid, for example, when the flying speed of the liquid droplet is enhanced, or when the ultraviolet curable ink whose viscosity of about 8 mPa·S or more is higher than the aqueous ink is discharged.

Figure 6:
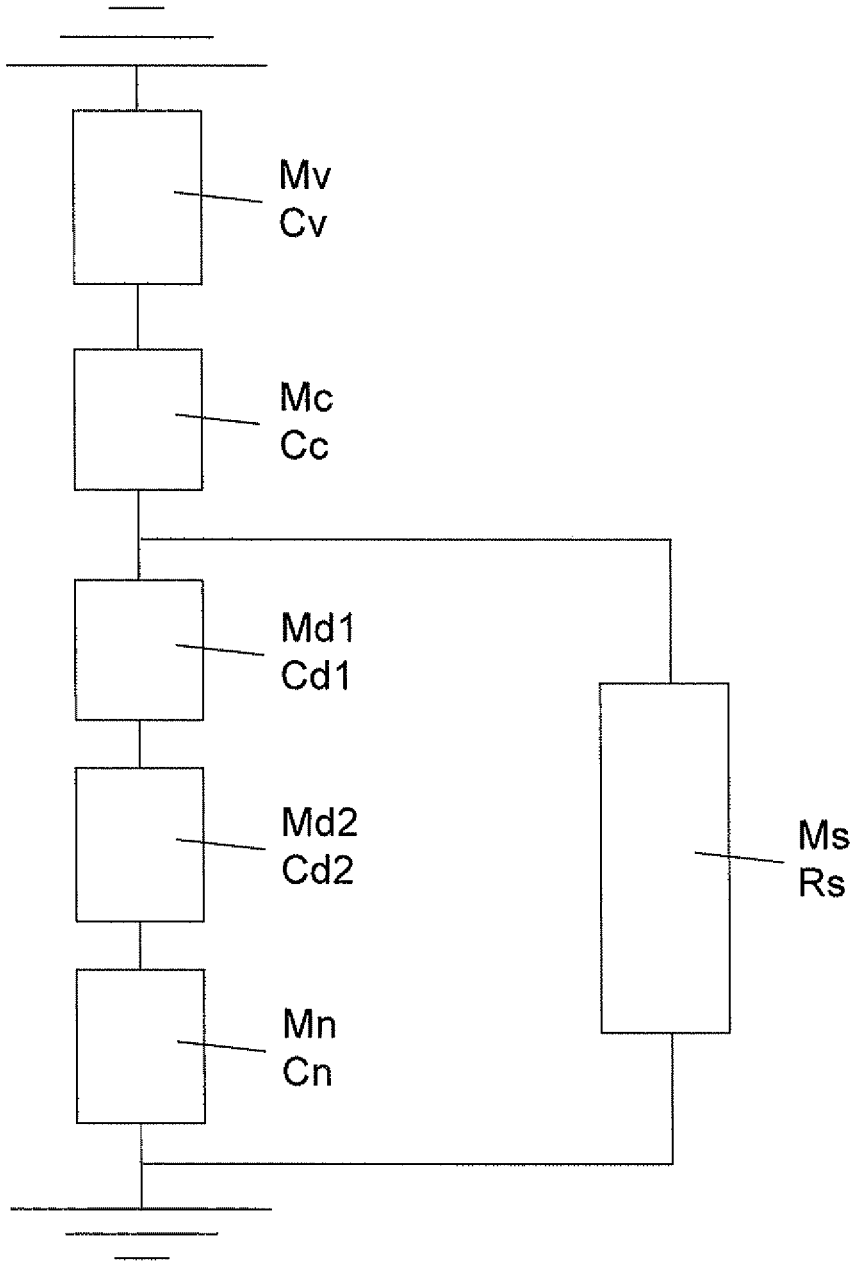
FIG. 6 is an equivalent circuit of an individual flow channel.

Therefore, it is conceivable that the narrow portion 7-3 is provided in the descender 7 to increase the damping of the pressure oscillation generated in the descender 7. FIG. 6 is an equivalent circuit of the individual flow channel 32 and the displacement element 50. The pressure applied by the displacement element 50 having inertance Mv ($kg/m^4$, hereinafter sometimes the unit is omitted) and compliance Cv ($m^5/N$, hereinafter sometimes the unit is omitted) propagates to the liquid pressurizing chamber 10 having inertance Mc and compliance Cc, and is divided into the side of the descender 7 and the throttle 12 having inertance Ms and compliance Cs. The side of the descender 7 is divided into the first descender 7-1 having inertance Md1 and compliance Cd1, the second descender 7-2 having inertance Md2 and compliance Cd2, and the liquid discharge hole 8 having inertance Mn and compliance Cn. Because the inertance and the compliance of the narrow portion 7-3 are small, the inertance and the compliance are omitted.

The pressure oscillation in the flow channel is hardly damped in the case of the high flow rates (masses) of the liquid pressurizing chamber 10 and the descender 7, namely, in the case of the high inertance. The pressure oscillation of the nozzle liquid level is hardly damped in the case of the small compliance of the liquid discharge hole 8. That is, the proper inertance and compliance are hardly obtained even if the liquid pressurizing chamber 10, the descender 7, and the liquid discharge hole 8 are independently controlled. Therefore, when the narrow portion 7-3 is provided in the descender 7, the inertance of the descender 7 can be decreased to improve the damping effect of the pressure oscillation in the flow channel.

Specifically, a length of the descender 7 is set to Ld0 (m), a length of the first descender 7-1 is set to Ld1 (m), a cross-section area of the first descender 7-1 is set to Sd1 ($m^2$), a length of the second descender 7-2 is set to Ld2 (m), a cross-section area of the second descender 7-2 is set to Sd2 ($m^2$), a length of the narrow portion 7-3 is set to Ld3 (m), and a cross-section area of the narrow portion 7-3 is set to Sd3 ($m^2$). Sd3 is Sd3≦0.7×Sd1 and Sd3≦0.7×Sd2. The inertance of the descender 7 can be decreased by setting the cross-section area Sd3 of the narrow portion 7-3 to the above range.

At this point, it is assumed that M1 (=Mc+Md1) is combined compliance of the liquid pressurizing chamber 10 and the first descender 7-1 while C1 (=Cc+Cd1) is combined compliance of the liquid pressurizing chamber 10 and the first descender 7-1, and it is assumed that M2 (=Mn+Md2) is combined compliance of the liquid discharge hole 8 and the second descender 7-2 while C2 (=Cn+Cd2) is combined compliance of the liquid discharge hole 8 and the second descender 7-2. By satisfying 0.2<Ld2/Ld0≦0.4, 0.17≦M2/M1≦0.25, and 0.18≦C2/C1≦0.23, the pressure oscillation in the descender 7 can be damped, and the unnecessary pressure oscillation that becomes a factor for the generation of the divided droplets can be reduced, which allows tendency of one liquid droplet to be enhanced.

In the case of the straight pipe shape, the inertance and the compliance of each portion of the descender 7 can be calculated as the cross-section area in the plane orthogonal to the direction in which the liquid flows and a flow channel length that is of the length of the line connecting the area centers of the cross-section areas. In the case of the shape except the straight pipe shape, the calculation can be performed similarly to the straight pipe shape when the straight pipe is bent in the middle, or when a difference of the cross-section area is about ±10. Even in the case of the shape except the straight pipe shape, the inertance and the compliance can be calculated by a well-known method, and the similar effect is obtained within the above ranges.

The enhancement of the tendency of one liquid droplet means that the discharged liquid droplet becomes one, the discharged liquid droplets are gathered into one liquid droplet, or the discharged liquid droplets land close to one another in the recording sheet P so as to form one pixel even if the liquid droplets are not gathered into one liquid droplet. Therefore, the one pixel can stably be formed when the tendency of one liquid droplet is enhanced.

The tendency of one liquid droplet is divided into the following four stages. The most stable state is one in which the liquid column formed on the liquid discharge hole 8 directly becomes one liquid droplet from the beginning of the discharge. The second most stable state is one in which the liquid column is divided into a plurality of liquid droplets, the rear liquid droplet is faster than the front liquid droplet, and the plurality of liquid droplets are gathered into one liquid droplet before landing in the recording sheet P, namely the liquid droplets are gathered into one liquid droplet during flying. The third most stable state is one in which, although the liquid column is divided into a plurality of liquid droplets and directly land in the recording sheet P, one pixel can be formed on the recording sheet P because the plurality of landed liquid droplets expand while overlapping one another. Examples of the third most stable state include the case in which the two liquid droplets land close to each other and the case in which, even if the two liquid droplets land far away from each other, one of the liquid droplets having the small amount does not largely expand from the other liquid droplet having the large amount. Because the difference of the landing position is increased in the case of the fast conveying speed of the recording sheet P, whether the one pixel is formed in the landing is influenced by the conveying speed of the recording sheet P. For example, in performing the recording of 600 dpi with the liquid discharge head 2, whether the one pixel is formed in the landing can be determined by a landing result when the recording sheet P is conveyed at the speed of 0.85 m/s.

When the liquid column becomes a plurality of liquid droplets while the front liquid droplet is faster than the rear liquid droplet, the plurality of liquid droplets land in the recording sheet P while separated from one another, thereby forming the plurality of pixels. This state is referred to as generation of a satellite.

When the length Ld3 of the narrow portion 7-3 satisfies 0.1≦Ld3/Ld0≦0.15, the divided droplets are hardly generated, the discharged liquid droplet easily becomes one, or the discharged liquid droplets are easily gathered into one during flying, so that the better image can be obtained.

When the cross-section area Sd3 of the narrow portion 7-3 is at least 0.3 time the cross-section area Sd1 of the first descender 7-1 and at least 0.3 time the cross-section area Sd2 of the second descender 7-2, an energy loss of the narrow portion 7-3 is decreased, so that the liquid droplet can be discharged with less energy. In other words; the energy necessary to discharge the liquid droplet at a certain discharge speed can be reduced, and a voltage applied to the displacement element 50 can be decreased.

Although the embodiment is described above, the invention is not limited to the embodiment. Various changes and modifications can be made without departing from the scope of the invention. For example, what is called a pullout type discharge method is described in the embodiment. In the pullout type discharge method, after a meniscus near the liquid discharge hole 8 is sucked by reducing the volume of the liquid pressurizing chamber 10, the volume of the liquid pressurizing chamber 10 is enlarged in synchronization with the reflected pressure, thereby discharging the liquid droplet. Similarly the pressure oscillation in the descender 7 can be damped to enhance the tendency of one liquid droplet in a push-out type discharge method in which, after the meniscus near the liquid discharge hole 8 is pushed out as the liquid column by enlarging the volume of the liquid pressurizing chamber 10, and a rear end of the liquid column is cut off by reducing the volume of the liquid pressurizing chamber 10 in synchronization with the reflected pressure.

EXAMPLES

That the tendency of one liquid droplet is enhanced by providing the narrow portion 7-3 was confirmed by preparing the liquid discharge head 2.

A tape including piezoelectric ceramic powders and an organic composition was formed by a general tape forming method such as a roll coater method and a slit coater method, and a plurality of green sheets that become the piezoelectric ceramic layers 21*a* and 21*b* after burning were prepared. An electrode paste that become the common electrode 34 was partially formed in a surface of the green sheet by a printing method. A via hole was made in part of the green sheet if needed, and a via conductor was inserted in the via hole.

Then the green sheets were stacked to prepare the stacked body, and the stacked body was closely bonded by pressurization. After closely bonded by the pressurization, the stacked body was burnt under a high-concentration oxygen atmosphere, the individual electrode 25 was printed in the surface of the burnt stacked body using an organic gold paste and burnt. Then the connection electrode 36 was printed using a Ag paste and burnt, thereby preparing the piezoelectric actuator unit 21.

The flow channel member 4 was prepared by stacking the plates 21 to 31 obtained by a rolling method. The holes that become the manifold 5, the individual supply flow channel 6, the liquid pressurizing chamber 10, and the descender 7 was made into predetermined shapes in the plates 22 to 31 by etching. In the etching forming, the cross-section area of the hole varies depending on the position in the thickness direction. However, when the variation falls within the range of ±10%, because of the small difference of acoustic characteristic between the hole and a cylindrical pipe having the same average cross-section area as that of the hole, the inertance and the compliance may be calculated as a cylindrical pipe. The base plate 23 to the supply plate 25 are stacked while the holes of the descender 7 are shifted. However, even in such cases, the difference between the hole of the descender 7 and the cylindrical pipe can be omitted when the decrease of the cross-section area caused by shifting the holes is about 10% or less.

The plates 22 to 31 are made of at least one kind of the metal selected from a group consisting of an Fe—Cr system, an Fe—Ni system, and a WC—TiC system. In the case of the use of the Fe—Cr system, a corrosion resistance to the ink is improved when the ink is used as the liquid. The Fe—Ni system can reduce the difference of the thermal expansion coefficient when the flow channel member 4 and the piezoelectric actuator unit 21 are bonded by the thermosetting resin. In the 42 alloy, the weak compressive stress can be applied to the piezoelectric actuator unit 21 when the flow channel member 4 and the piezoelectric actuator unit 21 are bonded by the thermosetting resin.

For example, the piezoelectric actuator unit 21 and the flow channel member 4 can be stacked and bonded with the bonding layer interposed therebetween. A well-known bonding agent can be used as the bonding layer, however, the bonding agent made f at least one kind of the thermosetting resin selected from the group consisting of the epoxy resin, the phenol resin, and the polyphenylene ether resin, which have the thermal curing temperature of 100 to 150° C., is used as the bonding layer in order not to affect the piezoelectric actuator unit 21 and the flow channel member 4. The bonding layer is heated to the thermal curing temperature to bond the piezoelectric actuator unit 21 and the flow channel member 4, which allows the liquid discharge head 2 to be obtained.

Thus, the liquid discharge head 2 having the vertical section shape illustrated in FIGS. 5(*a*) and 5(*b*) was prepared. The size of each portion and the acoustic characteristic of the individual flow channel 32 were set as follows. The inertance M ($kg/m^4$) and the compliance C ($m^5/N$) were calculated from M=ρL/S and C=W/ρc2 suing a volume W ($m^3$), the length L (m), the area S ($m^2$), liquid density ρ ($kg/m^2$), sound velocity c (m/s) of the liquid. Density of 1.04 $g/cm^3$ and the sound velocity of 1630 m of the ultraviolet curable ink were used as the values of the liquid density and the sound velocity. The ultraviolet curable ink had the viscosity of 8 mPa·S.

The liquid pressurizing chambers 10 having the depths of 50 μm, and 100 μm were prepared. The inertance Mc of the liquid pressurizing chambers 10 having the depths of 30 μm, 50 μm, and 100 μm was $1.12\times10^8$ $kg/m^4$, $6.72\times10^7$ $kg/m^4$, and $3.36\times10^7$ $kg/m^4$, and the compliance Cc of the liquid pressurizing chambers 10 was $3.32\times10^{-21}$ $m^5/N$, $5.54\times10^{-21}$ $m^5/N$, and $1.11\times10^{-20}$ $m^5/N$.

The length Ld0 of the descender 7 was set to 790 μm.

The first descender 7-1 had the length Ld1 of 530 μm. As a result of measuring and calculating the average cross-section area of the plates, the inertance Md1 of the first descender 7-1 was 2.03×107 kg/m4, and the compliance Cd1 was 5.25×10-21 m5/N.

The second descender 7-2 had the length Ld2 of 160 μm. As a result of measuring and calculating the average cross-section area of the plates, the inertance Md2 of the second descender 7-2 was $6.54\times10^6$ $kg/m^4$, and the compliance Cd1 was $1.47\times10^{-21}$ $m^5/N$.

In the average cross-section area Sd3 of the narrow portion 7-3 was set to 60% of the average cross-section area of the first descender 7-1 and 60% of the average cross-section area of the second descender 7-2, and the length Ld3 was set to 100 μm.

The liquid discharge holes 8 were prepared. That is, the length was set to 50 μm, the diameter of one of the openings facing the outside of the liquid discharge head 2 was set to 20 μm, 22 μm, and 24 μm, and the opening expanded at an angle of 15° on one side toward the inside of the liquid discharge head 2. The inertance Mn of the liquid discharge holes 8 was $1.77\times10^7$ $kg/m^4$, $1.54\times10^7$ $kg/m^4$, and $1.36\times10^7$ $kg/m^4$, and the compliance Cn was $3.49\times10^{-22}$ $m^5/N$, $5.11\times10^{-22}$ $m^5/N$, and $7.24\times10^{-22}$ $m^5/N$.

A discharge test was performed using the above liquid discharge head 2. The flying state of the liquid droplet to the position of 0.5 mm from the liquid discharge hole 8 was checked, and the state of the liquid droplet that lands in the recording sheet P conveyed at the speed of 0.85 m/s was checked. The evaluation was performed while classified into four stages, namely, A: the liquid droplets were gathered into one droplet from the beginning of the discharge, B: the liquid droplets were gathered into one droplet during flying, C: one pixel was formed on the recording sheet P although one liquid droplet was notable to be observed during flying, and D: the satellite was generated on the recording sheet P.

Tables 1 and 2 illustrate a ratio M2/M1 of the combined inertance and a ratio C2/C1 of the combined compliance in the nine kinds of combinations of the liquid pressurizing chambers 10 and the liquid discharge holes 8, which were tested. Table 3 illustrates evaluation results of the divided droplets state of the liquid droplet discharged from the liquid discharge head 2 in the nine kinds of combinations of the liquid pressurizing chambers 10 and the liquid discharge holes 8.

TABLE 1

Values of M2/M1

| Nozzle Diameter | M2 | Depth of Liquid Pressurizing Chamber [μm] 30 | 50 | 100 |
|---|---|---|---|---|
| | | M1 [$kg/m^4$] | | |
| [μm] | [$kg/m^4$] | $1.3\times10^8$ | $8.7\times10^7$ | $5.4\times10^7$ |
| 20 | $2.4\times10^7$ | 0.18 | 0.28 | 0.46 |
| 22 | $2.2\times10^7$ | 0.17 | 0.25 | 0.41 |
| 24 | $2.0\times10^7$ | 0.15 | 0.23 | 0.37 |

TABLE 2

Values of C2/C1

| Nozzle Diameter | C2 | Depth of Liquid Pressurizing Chamber [μm] 30 | 50 | 100 |
|---|---|---|---|---|
| | | C1 [$m^5/N$] | | |
| [μm] | [$m^5/N$] | $8.6\times10^{-21}$ | $1.1\times10^{-20}$ | $1.6\times10^{-20}$ |
| 20 | $1.8\times10^{-21}$ | 0.21 | 0.17 | 0.11 |
| 22 | $2.0\times10^{-21}$ | 0.23 | 0.18 | 0.12 |
| 24 | $2.2\times10^{-21}$ | 0.26 | 0.20 | 0.13 |

TABLE 3

| Evaluation Results of Divided Droplets | | | |
|---|---|---|---|
| Nozzle Diameter | Depth of Liquid Pressurizing Chamber [μm] | | |
| [μm] | 30 | 50 | 100 |
| 20 | C | D | D |
| 22 | C | A | D |
| 24 | D | C | D |

A: One droplet
B: Gathered into one droplet during flying
C: One pixel formed when landing
D: Satelite generated The state of C (one pixel in the landing) or more was made, and the good recording state was obtained, using the liquid discharge heads 2 of the combination of the liquid pressurizing chamber 10 having the depth of 30 μm and the liquid discharge hole 8 having the nozzle diameter of 20 μm, the combination of the liquid pressurizing chamber 10 having the depth of 30 μm and the liquid discharge hole 8 having the nozzle diameter of 22 μm, the combination of the liquid pressurizing chamber 10 having the depth of 50 μm and the liquid discharge hole 8 having the nozzle diameter of 22 μm, and the combination of the liquid pressurizing chamber 10 having the depth of 50 μm and the liquid discharge hole 8 having the nozzle diameter of 24 μm. The result shows that the tendency of one liquid droplet is enhanced in the range, in which the combined inertance has the ratio M2/M1 of $0.17 \leqq M2/M1 \leqq 0.25$ and the combined compliance has the ratio C2/C1 of $0.18 \leqq C2/C1 \leqq 0.23$. This is attributed to the fact that the unnecessary oscillation is damped in the descender 7.

Using the liquid discharge heads 2 of the combination of the liquid pressurizing chamber 10 having the depth of 50 μm and the liquid discharge hole 8 having the nozzle diameter of 22 μm, the length Ld2 of the second descender 7-2 and the length Ld3 of the narrow portion 7-3 varied, other dimensions were set to those of the initial test, and the ratio to the length Ld0 of the descender 7, which is illustrated in Table 2, was used.

TABLE 4

| Evaluation Results of Divided Droplets | | | | | |
|---|---|---|---|---|---|
| | Ld3/LdO | | | | |
| Ld2/LdO | 8% | 10% | 12% | 15% | 18% |
| 10% | D | D | D | D | D |
| 15% | D | D | D | D | D |
| 20% | B | A | A | A | B |
| 25% | B | A | A | A | B |
| 30% | B | A | A | A | B |
| 40% | B | A | A | A | B |
| 50% | D | D | D | D | D |
| 60% | D | D | D | D | D |

A: One droplet
B: Gathered into one droplet during flying
C: One pixel formed when landing
D: Satelite generated When Ld2/Ld0 ranges from 20% to 40%, the damping effect of the pressure oscillation is enhanced in the descender 7, and the discharged liquid droplet was one or the liquid droplets were gathered into one during flying. When Ld3/Ld0 ranges from 10% to 15%, the discharged-liquid droplet became one.

Using the liquid discharge heads 2 of the combination of the liquid pressurizing chamber 10 having the depth of 50 μm and the liquid discharge hole 8 having the nozzle diameter of 22 μm, Ld2/Ld0 was set to 30%, the length Ld3 and the cross-section area Sd3 of the narrow portion 7-3 varied, other dimensions were set to those of the initial test, and the ratio of Ld3 to the length Ld0 of the descender 7 and the ratio to the length Sd1 of the first descender 7-1 (that is identical to the ratio to the length Sd2 of the second descender 7-2), which are illustrated in Tables 5 and 6, were used. In addition to the above evaluations, the voltage necessary to set the discharged liquid droplet to 7 m/s was checked. Table 5 illustrates the evaluation results of the divided droplets state, and Table 6 illustrates the evaluation results of the voltage. In the voltage evaluation, the ratio to the voltage was described in the liquid discharge head in which Sd3/Sd1 whose divided droplets evaluation is A (discharge of one liquid droplet) is 70% while Ld3/Ld0 is 10%.

TABLE 5

| Evaluation Results of Divided Droplets | | | | | |
|---|---|---|---|---|---|
| | Ld3/Ld0 | | | | |
| Sd3/Sd1 | 8% | 10% | 12% | 15% | 18% |
| 20% | B | B | C | C | C |
| 30% | A | A | A | A | B |
| 40% | A | A | A | A | B |
| 50% | B | A | A | A | A |
| 60% | B | A | A | A | A |
| 70% | B | A | A | A | A |
| 80% | D | D | D | D | D |

A: One droplet
B: Gathered into one droplet during flying
C: One pixel formed when landing
D: Satelite generated

TABLE 6

| Voltage Evaluation | | | | | |
|---|---|---|---|---|---|
| | Ld3/Ld0 | | | | |
| Sd3/Sd1 | 8% | 10% | 12% | 15% | 18% |
| 20% | 116% | 117% | 118% | 120% | 123% |
| 30% | 109% | 110% | 111% | 112% | 114% |
| 40% | 106% | 107% | 108% | 109% | 111% |
| 50% | 103% | 104% | 105% | 106% | 108% |
| 60% | 101% | 102% | 103% | 104% | 106% |
| 70% | 99% | 100% | 101% | 102% | 104% |
| 80% | 98% | 99% | 100% | 101% | 103% |

Compared with the voltage in the liquid discharge head in which Sd3/Sd1 whose divided droplets evaluation is A (discharge of one liquid droplet) is 70% while Ld3/Ld0 is 10%, the good landing state was obtained at the low voltage of 114% or less in the liquid discharge head in which the Sd3/Sd1 is 30% or more

| EXPLANATION OF REFERENCE NUMERALS | |
|---|---|
| 1 | Printer |
| 2 | Liquid discharge head |
| 4 | Flow channel member |
| 5 | Manifold |
| 5a | Sub-manifold |
| 5b | Opening |

-continued

| EXPLANATION OF REFERENCE NUMERALS | |
|---|---|
| 6 | Individual supply flow channel |
| 7 | Descender (communication passage) |
| 7-1 | First descender (communication passage) |
| 7-2 | Second descender (communication passage) |
| 7-3 | Narrow portion of descender |
| 8 | Liquid discharge hole |
| 9 | Liquid pressurizing chamber group |
| 10 | Liquid pressurizing chamber |
| 11a, 11b, 11c, 11d | Liquid pressurizing chamber line |
| 12 | Throttle |
| 15a, 15b, 15c, 15d | Liquid discharge hole line |
| 21 | Piezoelectric actuator unit |
| 21a | Piezoelectric ceramic layer (diaphragm) |
| 21b | Piezoelectric ceramic layer |
| 22-31 | Plate |
| 32 | Individual flow channel |
| 34 | Common electrode |
| 35 | Individual electrode |
| 36 | Connection electrode |
| 50 | Displacement element |

The invention claimed is:

1. A liquid discharge head, comprising:

a liquid pressurizing chamber;

a pressurizing unit that applies a pressure to the liquid pressurizing chamber, a liquid discharge hole; and a communication passage that connects the liquid pressurizing chamber and the liquid discharge hole, wherein the communication passage comprises a narrow portion having a small cross-section area, a first communication passage defined by a portion between a connection end to the liquid pressurizing chamber and a connection end to the narrow portion, and a second communication passage defined by a portion between a connection end to the liquid discharge hole and the connection end to the narrow portion, and a cross-section area of the narrow portion is 0.7 time or less of a cross-section area of the first communication passage, and is 0.7 time or less of a cross-section area of the second communication passage, and $0.2 \leqq Ld2/Ld0 \leqq 0.4$, $0.17 \leqq M2/M1 \leqq 0.25$, and $0.18 \leqq C2/C1 \leqq 0.23$ are satisfied, where Ld0 (m) is a length of the communication passage, Ld2 (m) is a length of the second communication passage, M1 ($kg/m^4$) is a combined inertance of the liquid pressurizing chamber and the first communication passage, C1 ($m^5/N$) is a combined compliance of the liquid pressurizing chamber and the first communication passage, M2 ($kg/m^4$) is combined inertance of the liquid discharge hole and the second communication passage, and C2 ($m^5/N$) is combined compliance of the liquid discharge hole and the second communication passage.

2. The liquid discharge head according to claim 1, wherein $0.1 \leqq Ld3/Ld0 \leqq 0.15$ is satisfied, where Ld3 (m) is a length of the narrow portion.

3. The liquid discharge head according to claim 1, wherein the cross-section area of the narrow portion is 0.3 time or more of the cross-section area of the first communication passage, and is 0.3 time or more of the cross-section area of the second communication passage.

4. A recording device, comprising:

the liquid discharge head according to claim 1;

a conveying unit that conveys a recording medium to the liquid discharge head; and a control unit controlling drive of the liquid discharge head.

* * * * *